US007236140B2

(12) United States Patent
Vainer

(10) Patent No.: US 7,236,140 B2
(45) Date of Patent: Jun. 26, 2007

(54) FLAT ANTENNA HOLDER

(75) Inventor: Ilan Vainer, Kfar-Sava (IL)

(73) Assignee: MTI Wireless Edge, Ltd., Rosh Ha'Ayin (IL)

( * ) Notice: Subject to any disclaimer, the term of this patent is extended or adjusted under 35 U.S.C. 154(b) by 30 days.

(21) Appl. No.: 11/203,209

(22) Filed: Aug. 15, 2005

(65) Prior Publication Data

US 2007/0035465 A1 Feb. 15, 2007

(51) Int. Cl.
*H01Q 1/12* (2006.01)

(52) U.S. Cl. ..... 343/878; 343/882

(58) Field of Classification Search ..... 343/878, 343/887, 873, 880, 881, 882
See application file for complete search history.

(56) References Cited

U.S. PATENT DOCUMENTS

| | | | | | |
|---|---|---|---|---|---|
| 2,534,894 | A * | 12/1950 | Zedler | ..... | 248/537 |
| 3,220,006 | A * | 11/1965 | Young et al. | ..... | 343/708 |
| 5,734,356 | A * | 3/1998 | Chang | ..... | 343/882 |
| 5,886,674 | A * | 3/1999 | Yoshimi | ..... | 343/882 |
| 7,081,867 | B1 * | 7/2006 | Wang | ..... | 343/882 |
| 2006/0125711 | A1 * | 6/2006 | Wang | ..... | 343/882 |

* cited by examiner

*Primary Examiner*—Tho Phan
(74) *Attorney, Agent, or Firm*—Pearl Cohen Zedek Latzer, LLP

(57) ABSTRACT

Embodiments of the invention provide a single apparatus for connecting a flat antenna to a plurality of surfaces, including vertical, horizontal or other inclined surfaces, by screws, suction components or other connectors.

16 Claims, 4 Drawing Sheets

FLAT ANTENNA HOLDER

FIELD OF THE INVENTION

The present invention relates to antenna holders in general, and more particularly to a flat antenna holder apparatus.

BACKGROUND OF THE INVENTION

There is a need for connecting and attaching a flat antenna to plurality of surfaces, for example, horizontal surfaces and vertical surfaces made of different materials, for example, wood, concrete, glass, plastic or other materials. Furthermore a flat antenna may be positioned in variety of locations in accordance with the specific use and/or user preferences, for example, indoor locations such as, a window, a wall, a desk or outdoor locations.

SUMMARY OF THE INVENTION

An apparatus for connecting a flat antenna to a surface. The apparatus may include an attachment base, having at least one hole for attachment to the surface by screw, at least one hole for attachment to the surface by suction device, and at least one peg for being fitted to a weight and an attachment to a flat antenna.

BRIEF DESCRIPTION OF THE DRAWINGS

The present invention will be understood and appreciated more fully from the following detailed description taken in conjunction with the appended drawings in which.

Figure 1:
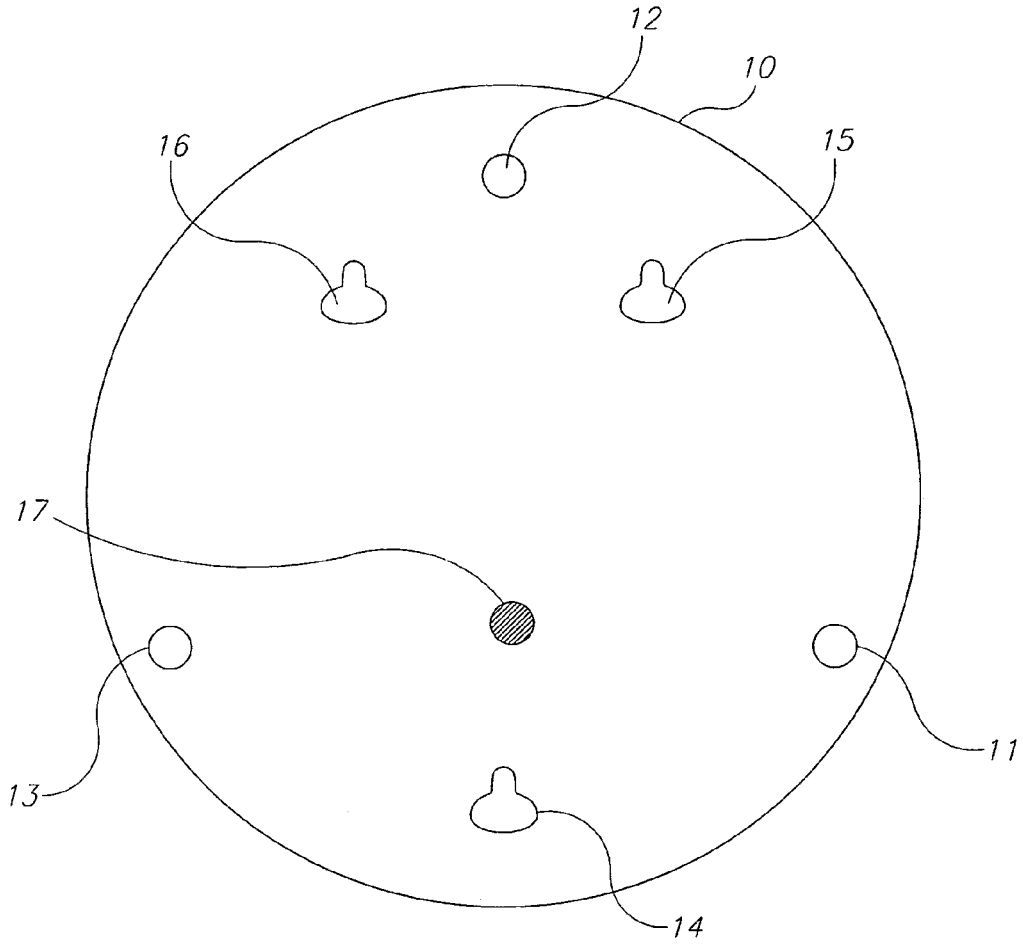
FIG. 1 is a schematic illustration of section or part of a flat antenna holder in accordance with some embodiments of the invention.

It will be appreciated that for simplicity and clarity of illustration, elements shown in the figures have not necessarily been drawn to scale. For example, the dimensions of some of the elements may be exaggerated relative to other elements for clarity. Further, where considered appropriate, reference numerals may be repeated among the figures to indicate corresponding or analogous elements.

DETAILED DESCRIPTION OF THE INVENTION

In the following detailed description, numerous specific details are set forth in order to provide a thorough understanding of the invention. However, it will be understood by those of ordinary skill in the art that the invention may be practiced without these specific details.

Reference is made now to FIG. 1 which is a schematic illustration of section or part of a flat antenna holder in accordance with some embodiments of the invention. It will be understood that although in the discussion below, element 10 is referred to as a flat antenna holder base, it will be understood there may be various configurations of a flat antenna holder in accordance with embodiments of the present invention; for example, in some embodiments of the invention, element 10 may be a part of the apparatus to be used in connection with other parts; in other embodiments, element 10 of FIG. 1 may be an interior section view of a single-piece flat antenna holder, etc.

Flat antenna holder base 10 may be used to place or attach a flat antenna to a plain surface, e.g., a table, a wall, a window or any other plain surface. According to some embodiments of the invention flat antenna holder base 10 may include holes 11, 12 and 13 for attaching flat antenna holder base 10 to a surface plane of any orientation using screws, nails, bolts, or other connectors. Flat antenna holder base 10 may include holes 14, 15 and 16, which may be key-shaped, for attaching flat antenna holder 10 to a smooth surface, e.g., glass, metal, plastic, etc. which may be vertical, horizontal or otherwise inclined, by using suction devices, such as small suction cups, as described in detail below. In an embodiment of the invention shown in FIG. 1, set of holes 11, 12 and 13 and set of holes 14, 15 and 16, may be spaced alternatingly and uniformly around flat antenna holder base 10.

According to embodiments of the invention flat antenna holder base 10 may include a peg or stub 17 located in proximity to, but preferably not exactly at, center of flat antenna holder base 10. Stub 17 may be used to attach a weight or joint load element to flat antenna holder base 10, as described in detail below. Stub 17 may be raised from the surface of flat antenna holder base 10 in a direction orthogonal to the surface plane and may be molded with, or fixedly or removably attached to flat antenna holder base 10.

Figure 2:
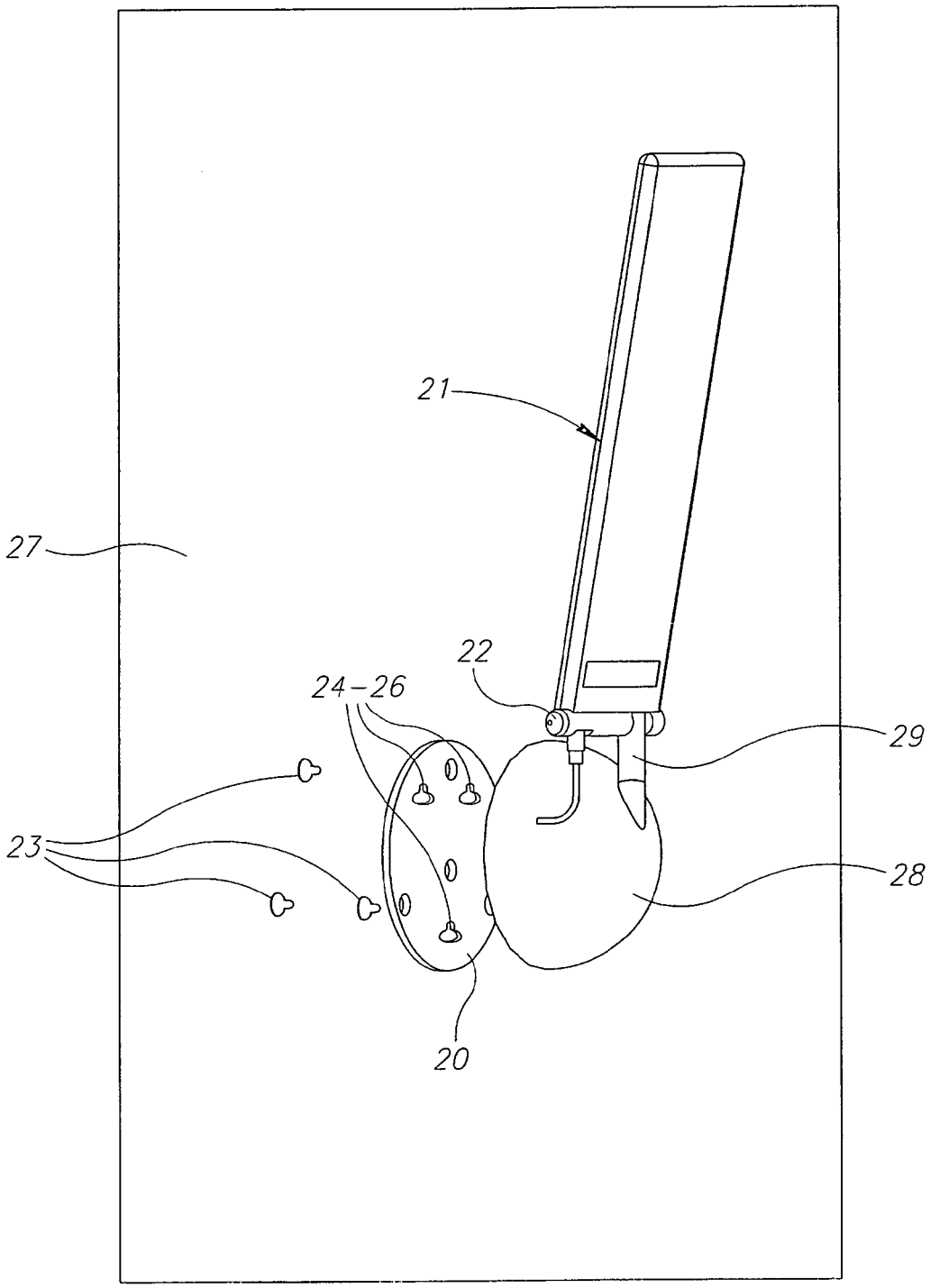
FIG. 2 is a perspective view of a flat antenna holder attached to a smooth vertical surface in accordance with use of an exemplary embodiment of the invention.

Reference is made now to FIG. 2, which is a perspective view of a flat antenna holder attached to a smooth vertical surface in accordance with use of an exemplary embodiment of the invention. It will be noted that in the embodiment of the invention shown, the flat antenna holder is shown as a two-part apparatus, including both a base and a dome 28. The based and dome may be attached by any suitable means, for example, by snaps, clips, adhesive, screws, etc. Flat antenna holder base 20 and dome 28 may connect a flat antenna 21 to a smooth surface 27, for example a vertical surface such as a window, a mirror, etc. According to some illustrative embodiments of the invention flat antenna holder base 20 may include three key-shaped holes 24, 25, and 26 similar to key-shaped holes shown in FIG. 1. Flat antenna holder 20 may be attached to surface 27 by inserting suction devices 23 into key-shaped holes 24, 25 and 26, and attaching suction devices 23 to smooth vertical surface 27. Suction devices 23 may also be sticky connectors or any other connectors suitable for attaching flat antenna holder base 20 to a smooth vertical surface. Connectors 23 may have an external and internal diameter to fit first into the large part of key-shaped holes 24, 25 and 26 and then slide the interior diameter of the connector into the narrow portion of the key-shaped holes.

According to some embodiments of the invention, flat antenna holder base 20 may include a dome 28 and a joint member 29 for attaching to a flat antenna 21. Joint member 29 may allow flat antenna 21 to swivel rotationally around joint member 29 with reference to dome 28. In addition, flat antenna 21 may include a hinge 22 which may be located at the bottom of flat antenna 21 and may be connected to joint member 29. Hinge 22 may permit pivoting the angle of the flat antenna with reference to dome 28. Flat antenna 21 may be fixedly or removably attached to flat antenna holder base 20 and/or dome 28, e.g., by screws, by glue, by a snap or by any other means.

Figure 3:
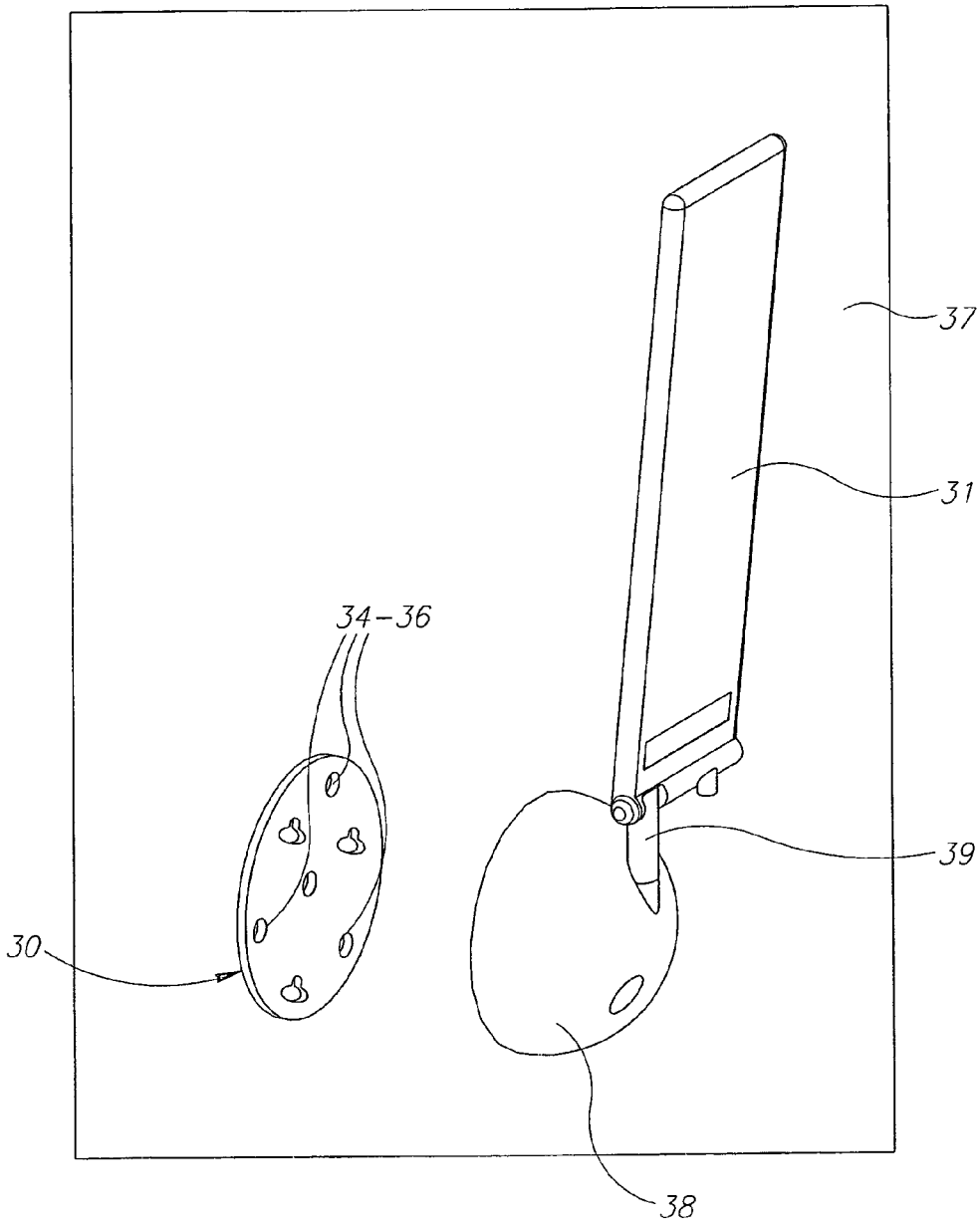
FIG. 3 is a perspective view of a flat antenna holder attachment to a vertical surface in accordance with some exemplary embodiments of the invention.

Reference is made now to FIG. 3, which is a perspective view of a flat antenna holder attachment to a vertical surface in accordance with some exemplary embodiments of the invention. In the embodiment of the invention shown in FIG. 3, the flat antenna holder base 30 may connect a flat antenna 31 to a surface 37 e.g., a vertical surface such as a wall, a door, or any other surface. According to some embodiments of the invention, flat antenna holder base 30 may include three round holes 34, 35 and 36. Flat antenna holder 30 may be connected to surface 37 by screws or nails through holes 34, 35 and 36.

Figure 4:
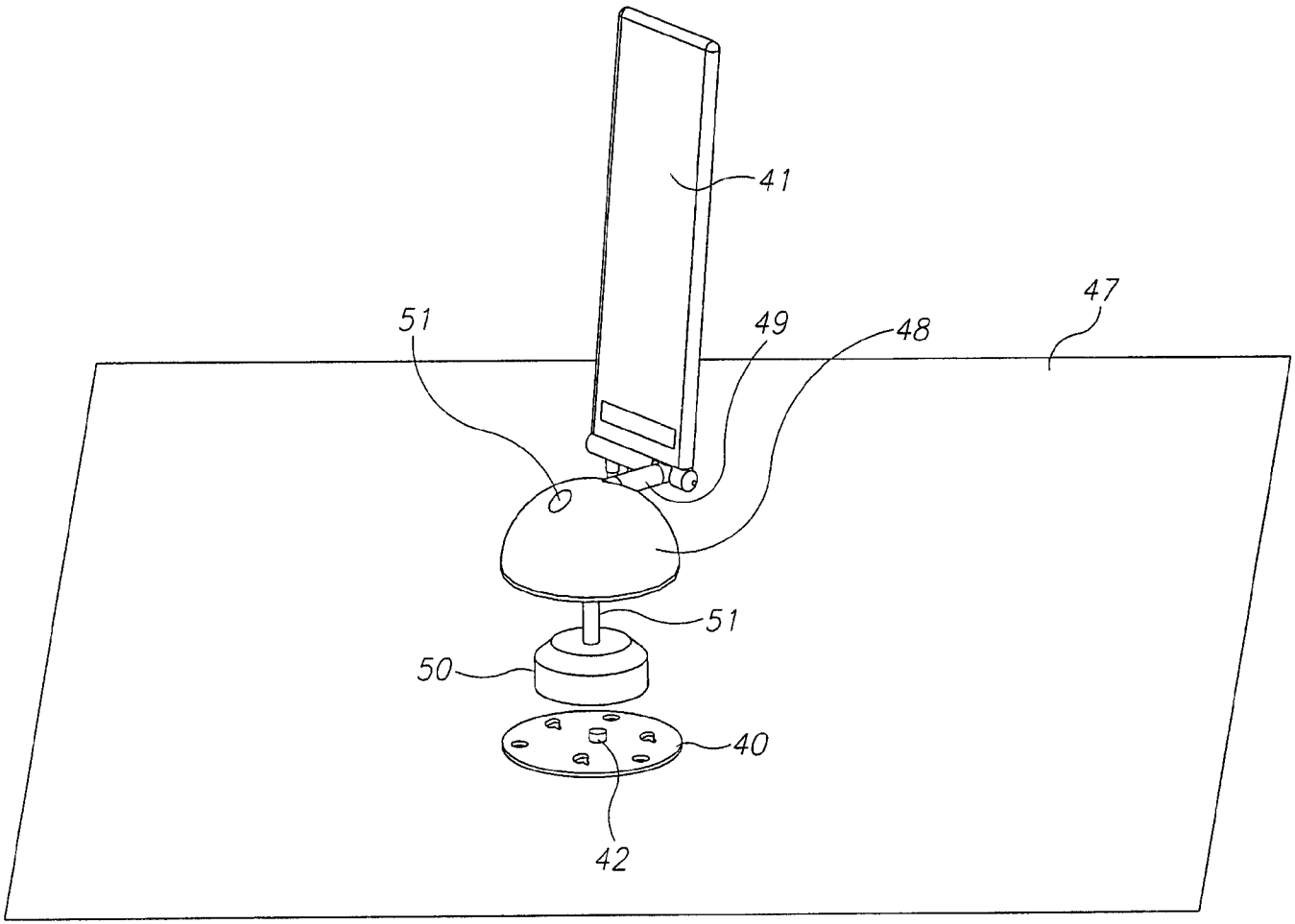
FIG. 4 is a perspective view of a flat antenna holder attached to a horizontal surface in accordance with some exemplary embodiments of the invention.

Reference is made now to FIG. 4, which is a perspective view of a flat antenna holder attached to a horizontal surface in accordance with some exemplary embodiments of the invention. Flat antenna holder base 40 may be used to place a flat antenna 41 on a horizontal surface 47 e.g., a desk, a shelf, or any other horizontal surface. According to some embodiments of the invention, the base of flat antenna holder base 40 may include a stub 42, on which may be placed a weight or load item 50. Stub 42 may be located in proximity to flat antenna holder 40 center. In some embodiments of the invention, the location of stub 42 and the weight of weight or load item 50 may be calculated to provide a counterbalance for the weight of antenna 41 to prevent tipping. Stub 17 may be molded with or fixedly or removably attached to flat antenna holder base 40 and may be raised from flat antenna holder base 40 surface. Stub 42 may have the shape and size to fit smoothly into a cavity in the bottom of weight 50. In some embodiments, dome 48 may have a peg 51 to fit into a cavity in the top of weight 50. In some embodiments, weight 50 may have a cavity bored through its entirety to permit a screw to be placed from dome 48, through weight 50 and attaching to stub 42. Stub 42 may be used to hold and stabilize flat antenna 41 to flat antenna holder base 40. It will be noted for purposes of illustration that the positions of flat antennas shown in the embodiments of the invention in FIGS. 2 and 4 differ for example, in the pivot angle about hinge 22 shown in FIG. 2.

While certain features of the invention have been illustrated and described herein, many modifications, substitutions, changes, and equivalents may occur to those skilled in the art. It is, therefore, to be understood that the appended claims are intended to cover all such modifications and changes as fall within the true spirit of the invention.

What is claimed is:

1. An apparatus for connecting a flat antenna to a surface comprising:

a flat antenna holder base, said holder base including at least one hole for attachment to the surface by screw, at least one hole for attachment to the surface by suction device, and at least one peg for being fitted to a weight; and an attachment to a flat antenna.

2. The apparatus of claim 1, wherein said at least one hole for attachment to the surface by suction device is a key-shaped hole.

3. The apparatus of claim 1, wherein said attachment to the flat antenna is capable of permitting the flat antenna to rotate about an axis perpendicular to said base.

4. The apparatus of claim 1, wherein said attachment to the flat antenna is capable of permitting the flat antenna to pivot about an axis parallel to said base.

5. The apparatus of claim 4, wherein said attachment to the flat antenna is capable of permitting the flat antenna to rotate on an axis perpendicular to said base.

6. The apparatus of claim 1, wherein said peg is placed away from the center of said holder base in the direction opposite to the attachment to the flat antenna.

7. The apparatus of claim 1, wherein said attachment to said flat antenna comprises a dome attached to said holder base.

8. The apparatus of claim 7, wherein said dome comprises an inverted peg for being fitted to a weight.

9. A system for connecting a flat antenna to a surface comprising:

a flat antenna, a flat antenna holder base including at least one hole for attachment to a coarse surface, at least one hole for attachment to a smooth surface, at least one peg for being fitted to a weight, means for attaching the flat antenna holder base to the coarse surface; and means for attaching the flat antenna holder base to the smooth surface.

10. The system of claim 9, wherein said at least one hole for attachment to the smooth surface by suction device is a key-shaped hole.

11. The system of claim 9, wherein said attachment to the flat antenna is capable of permitting the flat antenna to rotate about an axis perpendicular to said base.

12. The system of claim 9, wherein said attachment to the flat antenna is capable of permitting the flat antenna to pivot about an axis parallel to said base.

13. The system of claim 12, wherein said attachment to the flat antenna is capable of permitting the flat antenna to rotate on an axis perpendicular to said base.

14. The system of claim 9, wherein said peg is placed away from the center of said flat antenna holder base in the direction opposite to the attachment to the flat antenna.

15. The system of claim 9, wherein said attachment to said flat antenna comprises a dome attached to said flat antenna holder base.

16. The system of claim 15, wherein said dome comprises an inverted peg for being fitted to a weight.

* * * * *